US011274644B2

(12) United States Patent
Heininger et al.

(10) Patent No.: US 11,274,644 B2
(45) Date of Patent: Mar. 15, 2022

(54) REMOTE ENGINE START SYSTEM AND METHOD

(71) Applicant: Continental Automotive GmbH, Hannover (DE)

(72) Inventors: Franz Heininger, Witzmannsberg (DE); Tibor Gugger, Regensburg (DE)

(73) Assignee: Continental Automotive GmbH

( * ) Notice: Subject to any disclaimer, the term of this patent is extended or adjusted under 35 U.S.C. 154(b) by 350 days.

(21) Appl. No.: 16/589,533

(22) Filed: Oct. 1, 2019

(65) Prior Publication Data

US 2020/0109689 A1 Apr. 9, 2020

(30) Foreign Application Priority Data

Oct. 5, 2018 (DE) ..... 10 2018 217 113.0

(51) Int. Cl.
*F02N 11/08* (2006.01)

(52) U.S. Cl.
CPC ..... *F02N 11/0807* (2013.01); *F02N 11/0811* (2013.01); *F02N 2200/106* (2013.01); *F02N 2300/2011* (2013.01)

(58) Field of Classification Search
CPC ..... F02N 11/0807; F02N 11/0811; F02N 2300/2011; F02N 2200/106; F02N 11/10
See application file for complete search history.

(56) References Cited

U.S. PATENT DOCUMENTS 9,156,437 B2 10/2015 Kim
9,604,650 B2 3/2017 Geissenhoner
9,744,941 B2 8/2017 Geissenhoner
2011/0202201 A1 8/2011 Matsubara
2012/0078443 A1 3/2012 Matsubara
2016/0047348 A1* 2/2016 Bauerle ..... F02N 11/0807 290/38 C
2018/0222282 A1 8/2018 Tamane et al.

FOREIGN PATENT DOCUMENTS

DE 102011089072 A1 3/2013
DE 102013010984 A1 1/2015
DE 102013019140 B3 4/2015
DE 102018101401 A1 8/2018

OTHER PUBLICATIONS

German Examination Report for German Application No. 10 2018 217 113.0, with partial translation, dated May 29, 2019—7 pages.

* cited by examiner

*Primary Examiner* — James M McPherson
*Assistant Examiner* — Kyle J Kingsland
(74) *Attorney, Agent, or Firm* — RatnerPrestia

(57) ABSTRACT

In response to a triggering event, changing a vehicle remote engine start system from a first state to a second state. In the first state a remote engine start mode, a drive engine of the vehicle and a plurality of vehicle functions are deactivated. In the second state the remote engine start mode, at least one of the plurality of vehicle functions and the drive engine of the vehicle are activated. After activating the remote engine start mode, a timer is incremented or decremented from a predetermined start value. If the timer has not elapsed and the presence of a user is detected, the remote engine start system changes to a third state in which the last timer value and the current state of the remote engine start mode are stored and then the remote engine start mode and the timer are stopped, wherein the drive engine remains switched on.

8 Claims, 4 Drawing Sheets

REMOTE ENGINE START SYSTEM AND METHOD

CROSS REFERENCE TO RELATED APPLICATION

This application claims priority to German Patent Application No. 10 2018 217 113.0, filed Oct. 5, 2018, the contents of such application being incorporated by reference herein.

FIELD OF THE INVENTION

The invention relates to a remote engine start system and to a method, in particular a method for operating a remote engine start system in a vehicle.

BACKGROUND OF THE INVENTION

Remote engine start systems are known that permit a vehicle to be started by using a remote control. In this manner, it is possible for vehicles to be started without a user being inside or in direct proximity to the vehicle. The remote engine start function generally permits a vehicle to be started from a distance of up to 100 m or more. Such systems are also known as RES systems.

RES systems make it possible, for example, for a wide variety of vehicle functions to be already activated at a time at which the user is still away from the vehicle. For example, the vehicle interior can be air-conditioned such that the interior, upon entry of the user, has a pleasant temperature for the user. It is likewise possible, for example, for the vehicle battery to be charged by starting the internal combustion engine. A timer is generally started during the remote start of the engine. After the timer has elapsed, the engine is deactivated again in order to avoid unnecessary continuous running of the engine if the user has not taken himself/herself to the vehicle. It is thus possible, on the one hand, for the risk of hazards, for example poisoning, to be avoided or at least minimized. On the other hand, a situation can be prevented in which the fuel tank is completely emptied.

If the user approaches the vehicle while the RES function is activated, the RES function is generally deactivated, that is to say the vehicle returns to the normal state. However, the engine generally remains activated in order to increase the user-friendliness of the system. The vehicle functions can also remain activated if the user is situated in proximity to the vehicle and the RES function is deactivated.

SUMMARY OF THE INVENTION

An aspect of the invention aims to provide an improved remote engine start system and an improved method for operating a remote engine start system which are user-friendly and at the same time (additionally) minimize the risk of hazards.

A method comprises, in response to a triggering event, changing a remote engine start system in a vehicle from a first system state to a second system state, wherein in the first system state a remote engine start mode, a drive engine of the vehicle and a plurality of vehicle functions of the vehicle are deactivated, and wherein in the second system state the remote engine start mode, at least one of the plurality of vehicle functions and the drive engine of the vehicle are activated. After activating the remote engine start mode, a timer is incremented or decremented starting from a predetermined start value. If the timer has not yet elapsed and the presence of a user is detected, the remote engine start system changes to a third system state, wherein in the third system state the last timer value and the current state of the remote engine start mode are stored and then the remote engine start mode and the timer are stopped, wherein the drive engine remains switched on.

The method can further comprise, if it is detected that the user, after the presence thereof has been recognized, moves away again from the vehicle without having moved the vehicle, returning to the second system state, by continuing the remote engine start mode, re-establishing the stored timer value, and continuing the incrementing or decrementing of the timer.

A situation can thus be prevented in which the drive engine runs over too long a time in the absence of the user. In particular, a situation can also be prevented in which a user knowingly or unknowingly circumvents the running time limitation of the remaining timer time and the drive engine thereby remains longer in operation than provided for the system. Risk situations, for example, can be prevented in this way. However, the user comfort is maintained.

The method can further comprise, if it is detected that the timer has elapsed, changing to the first system state, by switching off the drive engine and deactivating the remote engine start mode.

It is also possible in this way to prevent a situation in which the drive engine runs in an uncontrolled manner over too long a time, in particular if a user does not approach the vehicle at all for a certain time after activating the remote engine start system.

The at least one vehicle function can also be deactivated with the switching off of the drive engine.

After the timer has elapsed, the system thus returns to its original state in which it found itself before the remote engine start system was activated.

The method can further comprise, if, after the detection of the presence of the user, the vehicle is moved before the user moves away again from the vehicle, deactivating the remote engine start mode and erasing the stored timer value and the stored state of the remote engine start mode.

In such a case, too, when the user also actually uses the vehicle after activating the remote engine start system, the system can return to the original state after the vehicle has been parked.

For the case that the user moves the vehicle, the method can further comprise, after the user has parked and switched off the vehicle again, switching off the drive engine and changing to the first state.

The triggering event can comprise the reception of a signal from a portable electronic device.

The user can thus activate the remote engine start system in a simple manner, for example by means of a remote control.

A remote engine start system in a vehicle comprises a timer. The remote engine start system is designed, in response to a triggering event, to change from a first system state to a second system state, wherein in the first system state a remote engine start mode, a drive engine of the vehicle and a plurality of vehicle functions of the vehicle are deactivated, and wherein in the second system state the remote engine start mode, at least one of the plurality of vehicle functions and a drive engine of the vehicle are activated. After changing to the second system state and activating the remote engine start mode, the timer is incremented or decremented starting from a predetermined start value. If the timer has not yet elapsed and the presence of a user is detected, the remote engine start system changes to a third system state, wherein in the third system state the last timer value and the current state of the remote engine start mode are stored and then the remote engine start mode and the timer are stopped, wherein the drive engine remains switched on.

The remote engine start system can further comprise a detection unit which is designed to detect the presence of a user.

BRIEF DESCRIPTION OF THE DRAWINGS

Aspects of the invention are explained in more detail below on the basis of the figures of the drawing, wherein identical or similar elements are provided with the same reference signs. In the drawing.

DETAILED DESCRIPTION OF THE PREFERRED EMBODIMENTS

Figure 1:
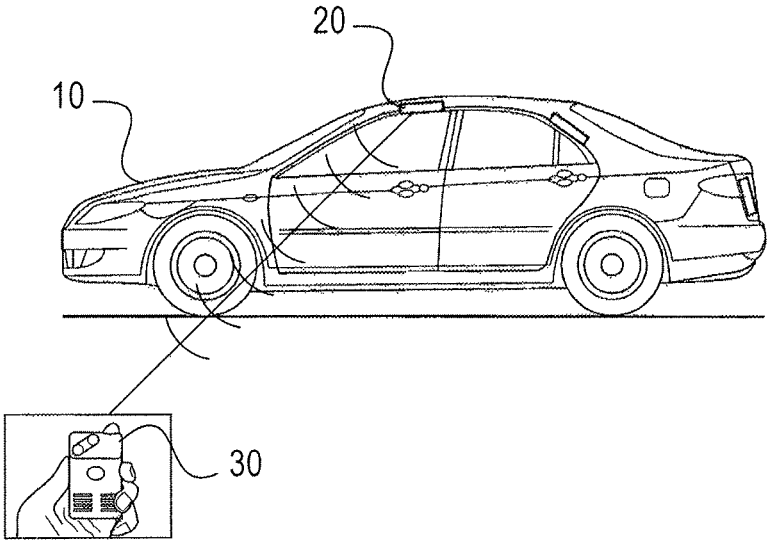
FIG. 1 shows in a schematic illustration the principle of a remote engine start system.

FIG. 1 shows by way of example a remote engine start system 20 in a vehicle 10. The remote engine start system 20 can receive signals from a portable electronic device, for example a remote control, 30. A user of the vehicle 10 can carry the portable electronic device 30 with him/her. Even if the user is not inside the vehicle 10 or in the immediate surroundings of the vehicle 10, he/she can trigger the starting of the vehicle 10 by actuating the portable electronic device 30. This means that when the user actuates, for example, a button (not explicitly shown) on the portable electronic device 30, a corresponding signal is sent to the vehicle 10. The remote engine start system 20 in the vehicle 10 can receive and evaluate the signal and then trigger the starting of the vehicle 10. In particular, this can involve the drive engine of the vehicle 10 being started. The drive engine (not shown in FIG. 1) can comprise an internal combustion engine, such as a diesel engine or a spark ignition engine, for example. The remote engine start system 20 can comprise a control unit, for example.

In this manner, for example various vehicle functions can already be activated even though the user is not yet in proximity to the vehicle 10. By way of example, when the drive engine is started, the air-conditioning system can begin to run. The interior of the vehicle 10 can thus already be cooled or heated before the user enters his/her vehicle 10. This is merely one example, however. It is possible for any other functions, in particular for example a wide variety of comfort functions, to be activated as soon as the vehicle 10 has been started. Purely charging a vehicle battery by starting the drive engine is also possible.

Signals between the portable electronic device 30 and the vehicle 10 can be transmitted by radio or via a mobile radio network, for example. The portable electronic device can be, for example, a remote control, an electronic vehicle key, a smartphone, a tablet, a laptop, or the like. The portable electronic device 30 can have a connection to a mobile radio network, for example, as can the vehicle 10. The mobile radio network can be used by the portable electronic device 30 and the vehicle 10 to communicate with one another.

Figure 2:
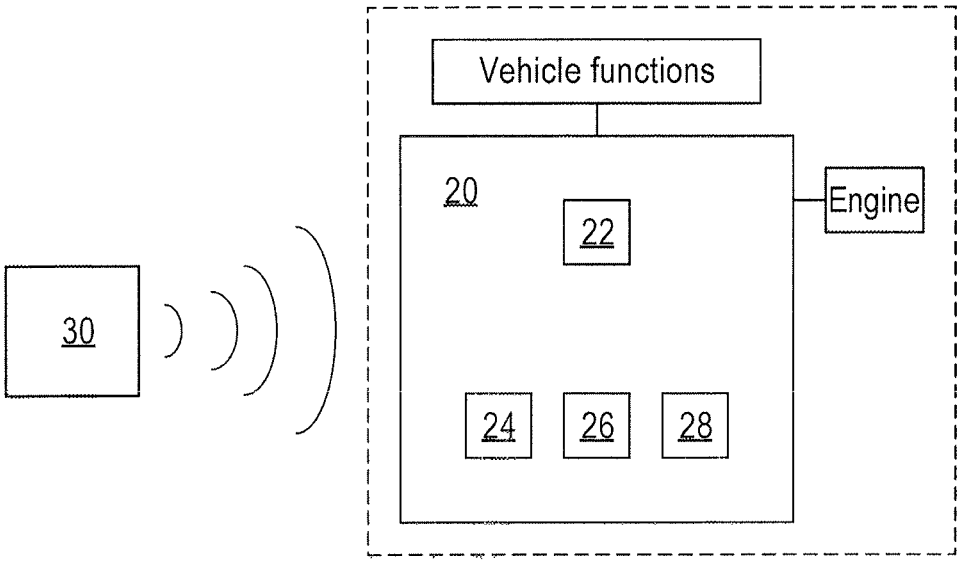
FIG. 2 shows in a block diagram a remote engine start system according to one embodiment of the invention.

With reference to FIG. 2, a remote engine start system 20 is illustrated by way of example. The remote engine start system 20 comprises an engine start unit 22. Furthermore, the remote engine start system 20 can also comprise a timer 24, a detection unit 26 and a memory 28. The remote engine start system 20, or the engine start unit 22, is designed to receive (engine start) signals from a portable electronic device 30. When the remote engine start system 22 receives the signals, this results in the drive engine being started up (engine start).

The portable electronic device 30 can comprise, for example, at least one button (not shown). The portable electronic device 30 can, for example, transmit signals to the vehicle 10 when a user actuates the button. However, the portable electronic device 30 can also comprise, for example, a touch display or any other input unit. Once these signals are received by the remote engine start system 20 in the vehicle 10, the engine start can be carried out. The remote engine start system 20 can further be designed to control at least one vehicle function. If a signal is received from the portable electronic device 30, not only can the drive engine be started but also at least one of the vehicle functions can be activated.

To prevent the drive engine from running in an uncontrolled manner over too long a time, a timer 24 is started when switching on the drive engine. The timer 24 can, for example, decrement a timer value beginning from a predetermined start value. However, it is also possible to increment the timer value starting from a start value. In both cases, the timer 24 has elapsed when a predetermined end value is reached. If the timer 24 is decremented, the end value is less than the start value; if the timer 24 is incremented, the end value is greater than the start value.

If the end value is reached and thus the timer 24 has elapsed, the drive engine can be switched off again. This prevents the drive engine from running in an uncontrolled manner over too long a time if the user, in spite of activating the remote engine start system 20, does not go to his/her vehicle 10 within a certain time. The previously activated vehicle functions are also deactivated again with the drive engine if the timer 24 has elapsed.

With the activation of the remote engine start system 20, the remote engine start system 20 thus changes from a first state, in which a remote engine start mode (remote engine control (RES) mode), the drive engine and a plurality of vehicle functions are deactivated, to a second state in which the remote engine start mode, the drive engine and at least one of the plurality of vehicle functions are activated. After the timer 24 has elapsed, the remote engine start system 20 then changes back again from the second state to the first state. For example, the timer 24 can elapse after 10 minutes or 20 minutes.

If, at a time at which the timer 24 has not yet elapsed, it is detected that the user moves toward the vehicle 10 (presence of the user detected), it is the case in current systems that the previously activated remote engine start mode is deactivated while the drive engine remains switched on. The at least one of the plurality of vehicle functions can also remain activated. The user comfort is thereby intended to be increased.

Figure 3:
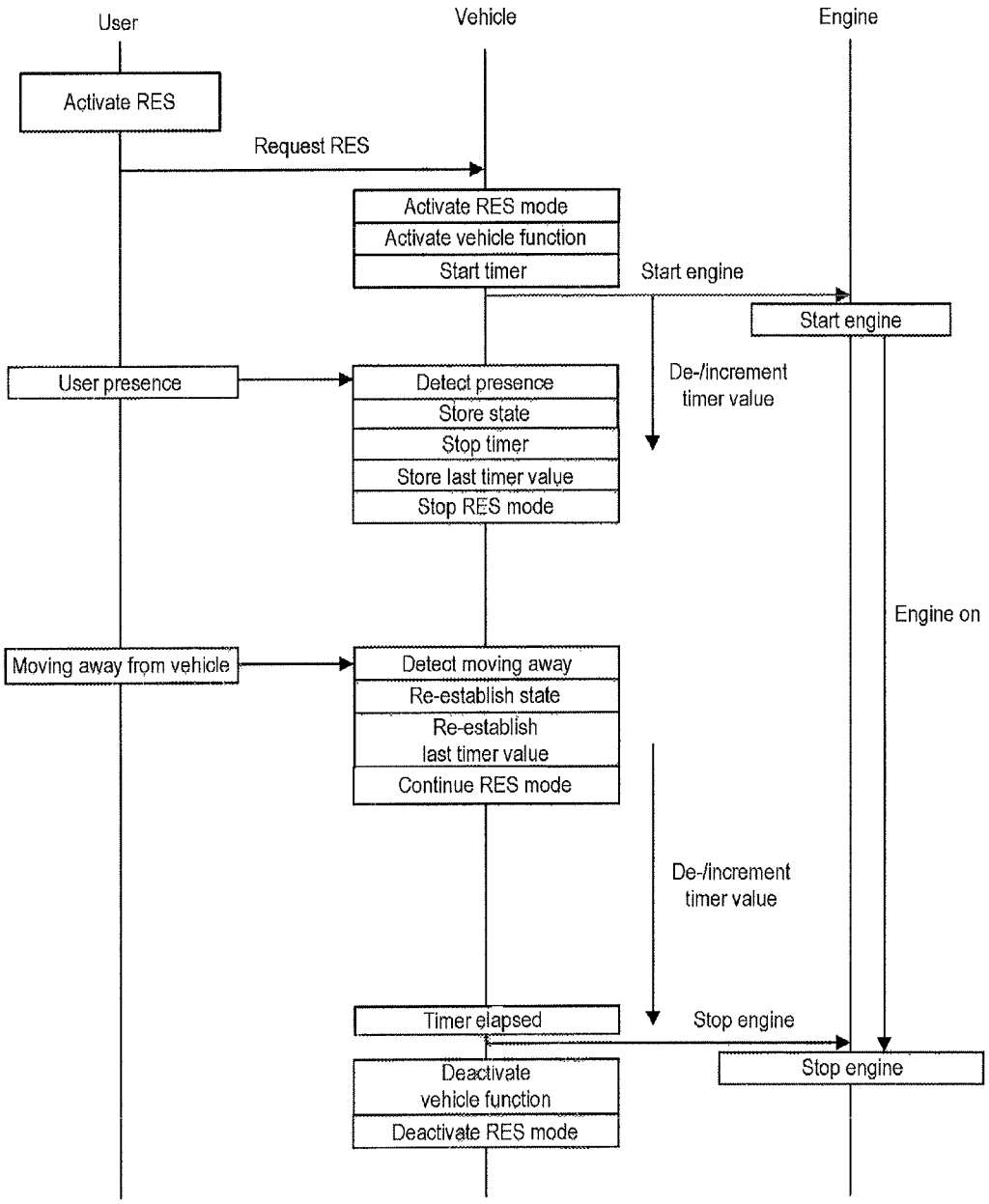
FIG. 3 shows in a sequence diagram an example of a method according to one embodiment.

With reference to FIG. 3, a method according to one embodiment of the invention is described. A user first transmits his/her request to start the remote engine start (remote engine control, RES) system to the vehicle. The vehicle then changes from the first state to the second state. That is to say that the RES mode is activated, the drive engine is started and at least one of the plurality of vehicle functions (for example air-conditioning system) is activated. The timer value is then incremented or decremented. If, as long as the timer has not yet elapsed, the presence of the user is detected in or at the vehicle, for example within the vehicle or within a certain radius around the vehicle, the timer is stopped and the current timer value is stored. Furthermore, the current state of the remote engine start mode is stored (for example store "remote engine start mode activated" state). Before thus the remote engine start system changes from the second state to a third state, information is stored on the fact that the remote engine start system was in the second state at the time at which the timer was stopped, that is to say that the RES mode was activated.

The remote engine start system then changes to the third state. The previously activated RES mode is stopped in the third state. However, the drive engine continues to run and is not switched off. The at least one vehicle function can also remain activated. If, however, the user then moves away again from the vehicle without using the vehicle, the drive engine would continue to run in an uncontrolled manner in conventional systems since the RES mode and the timer have been stopped. However, in the present method, as described, the last timer value and the last state (RES mode activated) are stored. For this purpose, the remote engine start system 20 can comprise a memory 28 (see FIG. 2). If the remote engine start system 20 then no longer detects a presence of the user since the latter moves away again from the vehicle without having moved the vehicle, said system can re-establish the last stored timer value and re-adopt the stored state (continue RES mode and change back from the third state to the second state). The system thus re-adopts the state in which it found itself before the presence of the user was detected. The timer continues to run from the re-established value. If the user does not come back once more to the vehicle and the timer has elapsed, the drive engine is switched off and the at least one vehicle function is deactivated again. The RES mode is then likewise deactivated.

It is in this way possible to prevent the engine continuing to run in an uncontrolled manner if at first the user presence was previously detected at the vehicle, but the user has then moved away again from the vehicle and a presence of the user can no longer be detected. Such a situation can occur for example if the user moves toward the vehicle and then turns back again since he/she has forgotten something, for example. It is also possible that the user thereby knowingly attempts to circumvent the running time limitation of the timer.

The presence of the user can be detected in a wide variety of ways. For this purpose, the remote engine start system 20 can comprise a detection unit 26, for example. For example, the detection unit 26 can comprise cameras or other sensors which are suitable for detecting a presence of the user. According to one example, the user presence is recognized when a vehicle door is opened. However, the user presence can also be detected in any other way.

Figure 4:
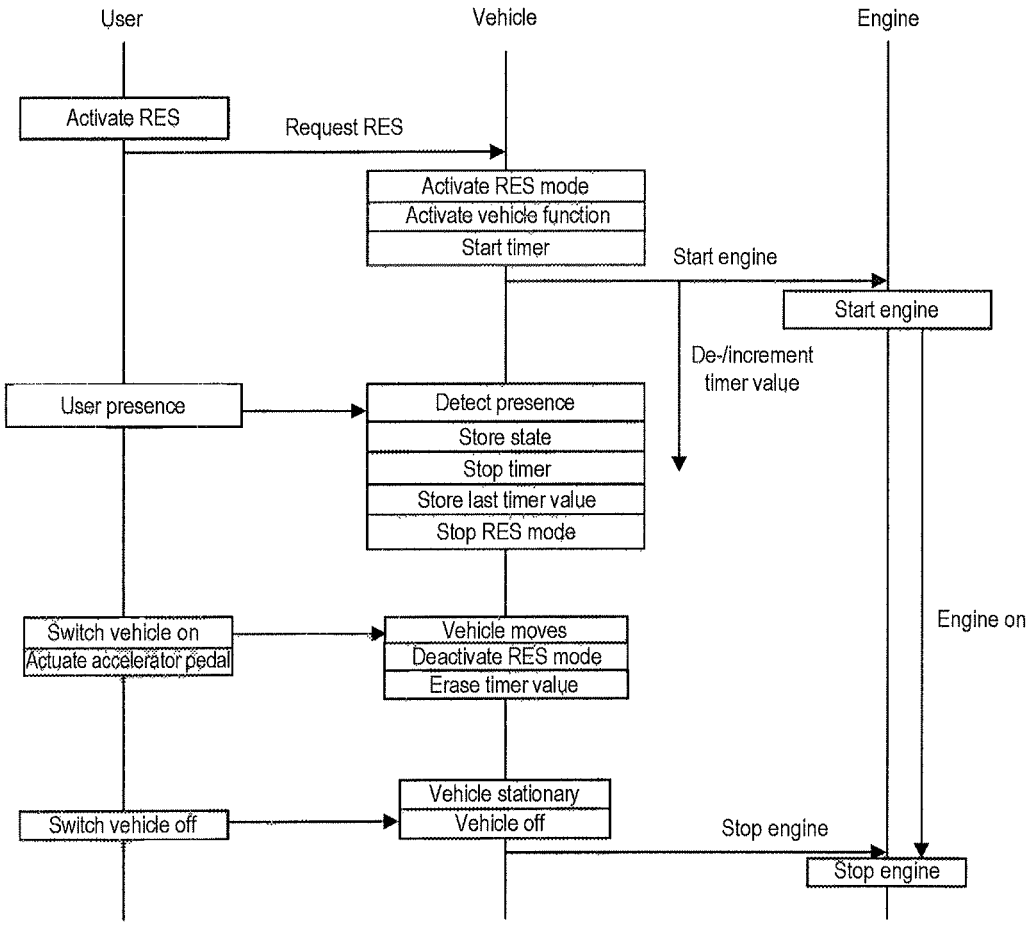
FIG. 4 shows in a sequence diagram an example of a further method according to one embodiment.

FIG. 4 shows by way of example a method according to one embodiment when the user approaches the vehicle and then also moves it. At first, the method corresponds to the method described on the basis of FIG. 3. That is to say that the remote engine start system changes from the first to the second state, activates the RES mode and at least one vehicle function and starts the drive engine. If the presence of the user is detected, the timer is stopped, the last timer value and the last state are stored, and the remote engine start system changes from the second state to the third state (RES mode stopped). Since the drive engine is already running, the user does not have to start it once again. However, a start button can possibly be actuated in order to indicate the request of the user to move the vehicle. The stored timer value and the stored state (RES mode activated) can be erased at this time. That is to say that the RES mode is completely deactivated. A wide variety of triggering events which trigger the deactivation of the RES mode are conceivable, for example also the actuation of an accelerator pedal and movement of the vehicle, in order to trigger erasing of the stored timer value and state.

After the user has parked the vehicle, he/she generally actuates the start button again or removes the vehicle key from the ignition lock to switch off the drive engine again. At this time, the system changes again to the first state. That is to say that the drive engine and the vehicle functions are also switched off.

Figure 5:
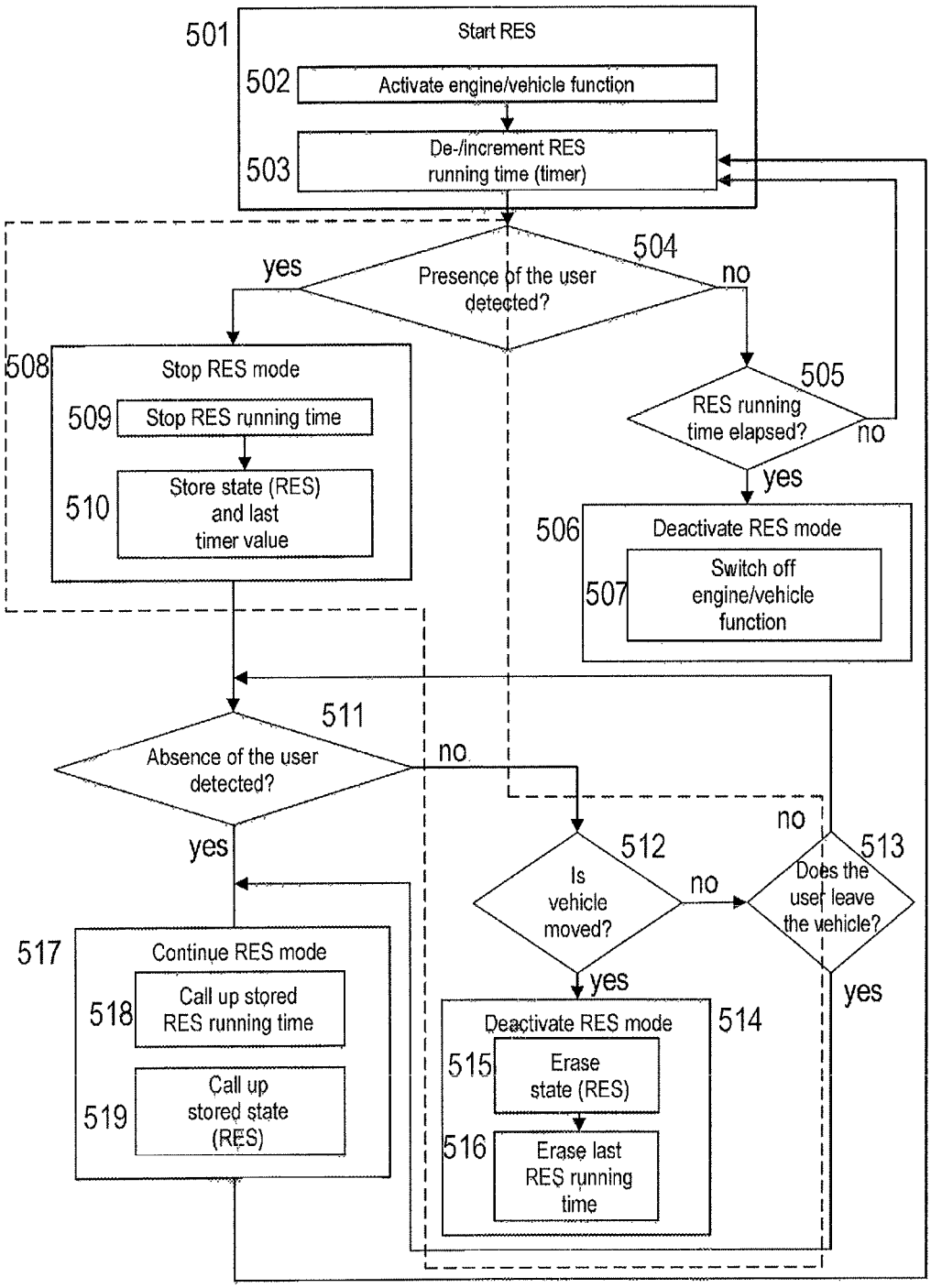
FIG. 5 shows in a flow diagram a method for operating a remote engine start system according to one embodiment of the invention.

FIG. 5 shows by way of example, in a flow diagram, a method for operating a remote engine start system. The method substantially corresponds to the methods described in FIGS. 3 and 4. In a first step, the remote engine start system (RES) is activated (step 501), that is to say that the RES mode is activated. The engine and at least one vehicle function are started (step 502). The RES running time, that is to say for example a timer, can be decremented or incremented beginning from a start value (step 503). If a user presence is not detected (step 504) and if the RES running time has not yet elapsed (step 505), the RES running time (the timer) is further decremented or incremented (step 503). If the user presence is not detected and if the RES running time has elapsed (step 505), the RES mode is deactivated (step 506). At the same time, the engine can also be switched off and the at least one vehicle function deactivated (step 507).

If the user presence is detected (step 504) at a time at which the RES running time has not yet elapsed, the RES mode is stopped (step 508), the RES running time is stopped (step 509) and the current state (RES) and timer value (remaining RES running time) are stored (step 510). If then the absence of the user is detected (step 511), the RES mode is continued (step 517) and the last timer value (stored remaining RES running time) is called up and re-established (step 518). The stored state (RES) is also called up again (step 519). The timer (the RES running time) is then further decremented, or incremented (step 503). If the user approaches a further time (user presence detected), the described steps are repeated. If the user does not approach once more and the timer has elapsed (steps 504 and 505), the RES mode is deactivated (step 506) and the engine and the at least one vehicle function are switched off (step 507).

If in step 511 the absence of a user is not detected (user still present), and the vehicle is moved (step 512), the RES mode can be completely deactivated (step 514). That is to say that the previously stored state (RES) and the stored remaining RES running time can be erased (states 515 and 516). If the vehicle is not moved (step 512) and the user does not leave the vehicle (step 513), the system can remain in this state until either the vehicle is moved or the user moves away again from the vehicle. If the vehicle is not moved and the user does not move away again from the vehicle (steps 512 and 513), the method is continued, as described above, with step 517, that is to say that the RES mode is continued as described.

As soon as the user presence is detected (step 504), the user can take control over the vehicle. The user has control over the vehicle as long as his/her presence is detected. In FIG. 5, all steps during which the user has control over the vehicle are enclosed in the box illustrated with dashed lines.

LIST OF REFERENCE SIGNS

10 Vehicle
20 Remote engine start system
22 Engine start unit
24 Timer
26 Detection unit
28 Memory
30 Portable device

The invention claimed is:

1. A method comprising:

in response to a triggering event, changing a remote engine start system in a vehicle from a first system state to a second system state, wherein in the first system state a remote engine start mode, a drive engine of the vehicle and a plurality of vehicle functions of the vehicle are deactivated, and wherein in the second system state the remote engine start mode, at least one of the plurality of vehicle functions and the drive engine of the vehicle are activated;

after activating the remote engine start mode, incrementing or decrementing a timer, starting from a predetermined start value;

if the timer has not yet elapsed and the presence of a user is detected, changing to a third system state, wherein in the third system state the last timer value and the current state of the remote engine start mode are stored and then the remote engine start mode and the timer are stopped, wherein the drive engine remains switched on;

if it is detected that the user, after the presence thereof has been recognized, moves away again from the vehicle without having moved the vehicle, returning to the second system state, by continuing the remote engine start mode, re-establishing the stored timer value, and continuing the incrementing or decrementing of the timer.

2. The method as claimed in claim 1, further comprising:

if it is detected that the timer has elapsed, changing to the first system state, by switching off the drive engine and deactivating the remote engine start mode.

3. The method as claimed in claim 2, wherein the at least one vehicle function is also deactivated with the switching off of the drive engine.

4. The method as claimed in claim 1, further comprising:

if, after the detection of the presence of the user, the vehicle is moved before the user moves away again from the vehicle, deactivating the remote engine start mode and erasing the stared timer value and the stored state of the remote engine start mode.

5. The method as claimed in claim 4, further comprising:

after the user has parked and switched off the vehicle, switching off the drive engine and changing to the first state.

6. The method as claimed in claim 1, wherein the triggering event comprises the reception of a signal from a portable electronic device.

7. A remote engine start system in a vehicle, wherein the remote engine start system comprises a timer, and wherein the remote engine start system is designed, in response to a triggering event, to change from a first system state to a second system state, wherein in the first system state a remote engine start mode, a drive engine of the vehicle and a plurality of vehicle functions of the vehicle are deactivated, and wherein in the second system state the remote engine start mode, at least one of the plurality of vehicle functions and a drive engine of the vehicle are activated;

after changing to the second system state and activating the remote engine start mode, incrementing or decrementing the timer, starting from a predetermined start value;

if the timer has not yet elapsed and the presence of a user is detected, changing to a third system state, wherein in the third system state the last timer value and the current state of the remote engine start mode are stored and then the remote engine start mode and the timer are stopped, wherein the drive engine remains switched on;

if it is detected that the user, after the presence thereof has been recognized, moves away again from the vehicle without having moved the vehicle, returning to the second system state, by continuing the remote engine start mode, re-establishing the stored timer value, and continuing the incrementing or decrementing of the timer.

8. The remote engine start system as claimed in claim 7, further comprising a detection unit to detect the presence of a user.

* * * * *